US006302560B1

(12) United States Patent
Lai

(10) Patent No.: US 6,302,560 B1
(45) Date of Patent: Oct. 16, 2001

(54) DECORATION LAMP HOLDER

(76) Inventor: Wei-Cheng Lai, No. 100-36, Der Sheng Village, Hukou Hsiang, Hsinchu Hsien (TW)

( * ) Notice: Subject to any disclaimer, the term of this patent is extended or adjusted under 35 U.S.C. 154(b) by 0 days.

(21) Appl. No.: 09/556,237

(22) Filed: Apr. 24, 2000

(51) Int. Cl.[7] ..... F21V 21/00

(52) U.S. Cl. ..... 362/249; 362/145; 362/252; 362/391

(58) Field of Search ..... 362/249, 250, 362/252, 145, 391, 239, 240

(56) References Cited

U.S. PATENT DOCUMENTS 5,510,966 * 4/1996 Konecny ..... 362/249

* cited by examiner

*Primary Examiner*—Sandra O'Shea
*Assistant Examiner*—John Anthony Ward

(57) ABSTRACT

A decoration lamp holder which is made of flexible, highly transparent, and thermally endurable material, and forms a straight opening to contain a string of Christmas decoration lamps is disclosed. Each of two internal sidewalls of the straight opening includes a side slot to accommodate one of two respective stop blocks beside the lamp string. The internal bottom of the straight opening can contain all the wire of the lamp string. The decoration lamp holder is thus easily bent to any desired shape with high diversity in use.

12 Claims, 8 Drawing Sheets

DECORATION LAMP HOLDER

FIELD OF THE INVENTION

The present invention relates to a decoration lamp holder and more specifically, to a lamp holder which is made of flexible highly transparent, and thermally endurable material, and contains a string of Christmas decoration lamps with any desired shape.

BACKGROUND OF THE INVENTION

The Christmas decoration lamp string has been widely used in many celebration occasions to enhance the sense of twinkling stars at night. However, the lamp strings hanging on the Christmas tree or around the house are boring and monotonous because of the lack of diversity. The traditional lamp string can not form a three dimensional shape in some specific cases. It has been very desirable to design a special lamp holder which can contain the lamp string and be easily deformed to any desired shape.

SUMMARY OF THE INVENTION

An object of the present invention is to provide a decoration lamp holder with diversity of shapes, which is used to clamp the lamp string as many as desired and can be bent to any shape in advance to enhance the visual sense. More than one decoration lamp holder is jointed together to create diversified outlooks.

Another object of the present invention is to provide a decoration lamp holder, which is adhered by a two-sided tape at the back side and can be easily fixed to the wall or the glass of a house. The user may also use nails to fix the decoration lamp holder on the wall. Therefore, various methods are provided for the user to decorate the celebration occasion.

Other features and advantages of the invention will become apparent from the following description of the invention that refers to the accompanying drawings.

DETAILED DESCRIPTION OF THE PREFERRED EMBODIMENTS

Figure 1:
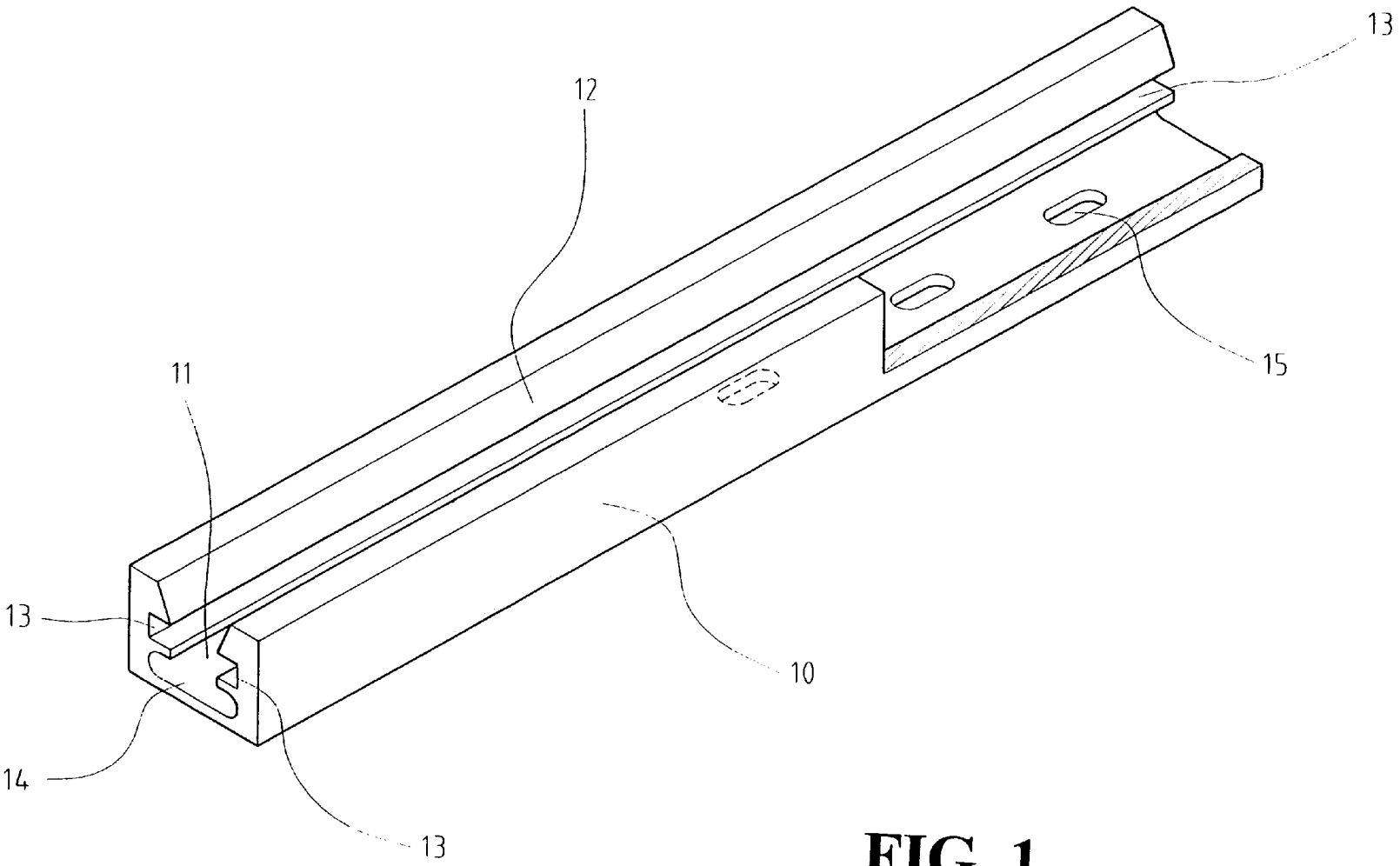
FIG. 1 is a three dimensional view of one embodiment of the lamp holder in accordance with the present invention.
Figure 2:
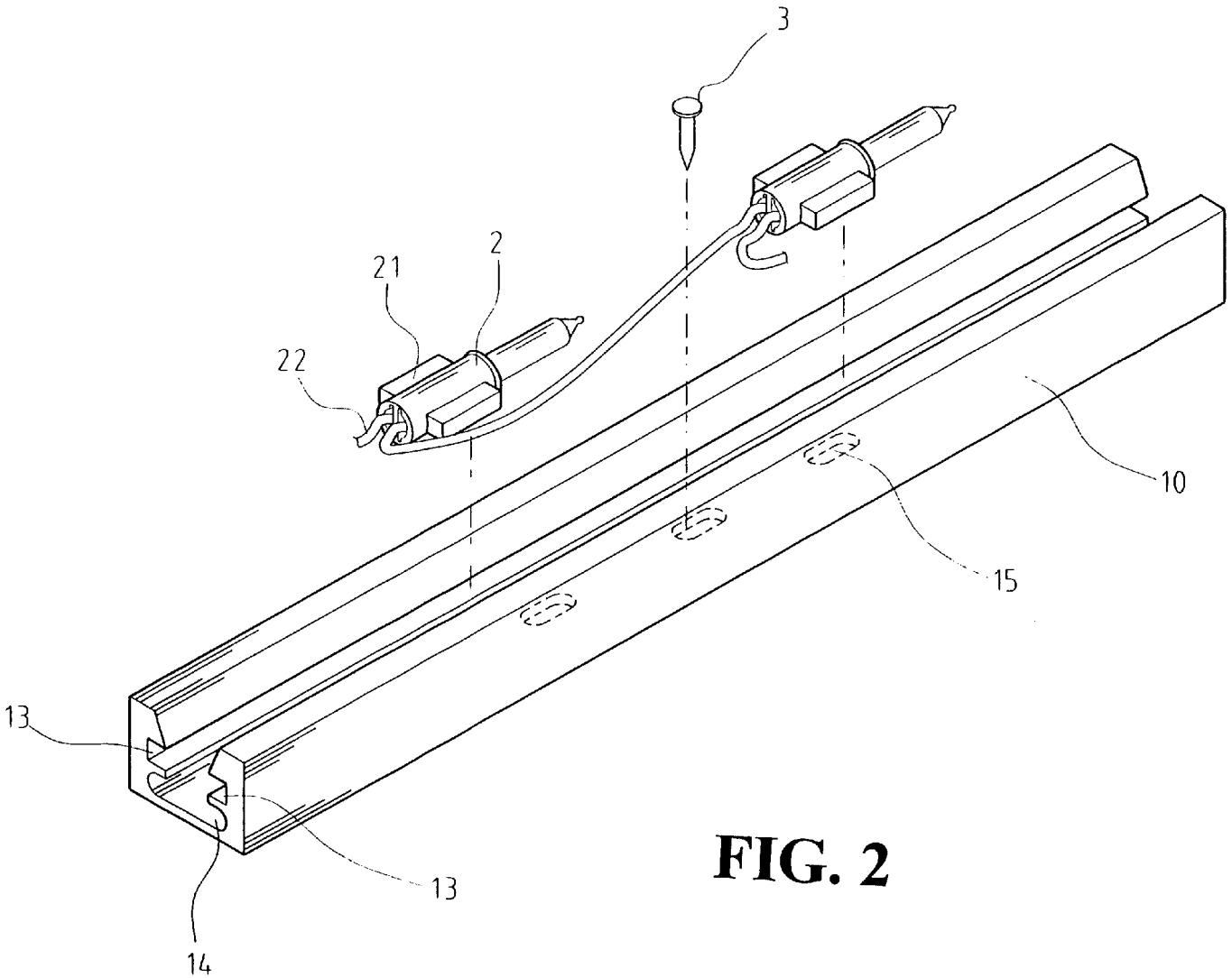
FIG. 2 is an explosion view of the lamp holder in accordance with the present invention.

With reference to FIG. 1, the three dimensional view of the lamp holder in accordance with the present invention shows the lamp holder 10 is a transparent and straight rod with a length as the user desires and only a small portion of the lamp holder 10 is illustrated herein. The cross sectional view of the lamp holder 10 looks like a rectangular shape with an opening at the middle section of the top to form a containing space 11, which accommodates the lamp string without further shielding the light radiated by the lamps in the lamp string. The opening at the top is formed by two oblique surfaces as a taper hole 12 so as to firmly clamp the lamp string. As shown in FIGS. 1 and 2, the middle section of the containing space 11 within the lamp holder 10 comprises two side slot 13 at each side. Each side slot 13 is coordinated with the respective stop block 21 of the lamp string 2 in order to further prevent the lamp string 2 from loosing after being assembled. Furthermore, the lamp holder 10 is made of flexible material so as to easily contain the lamp string 2. The most bottom of the containing space 11 forms a larger containing slot 14 to contain the wire 22 of the lamp string 2 so that the wire 22 is hidden within the lamp holder 10 after being assembled with nice outlook. The containing slot 14 further comprises a plurality of long holes 15 through the lamp holder 10, each long hole 15 used to fix the lamp holder 10 to the wall by a nail 3. Additionally, the user may use two-sided tape to adhere to the bottom of the lamp holder 10 so as to achieve the purpose of fixing the lamp holder 10.

Figure 3:
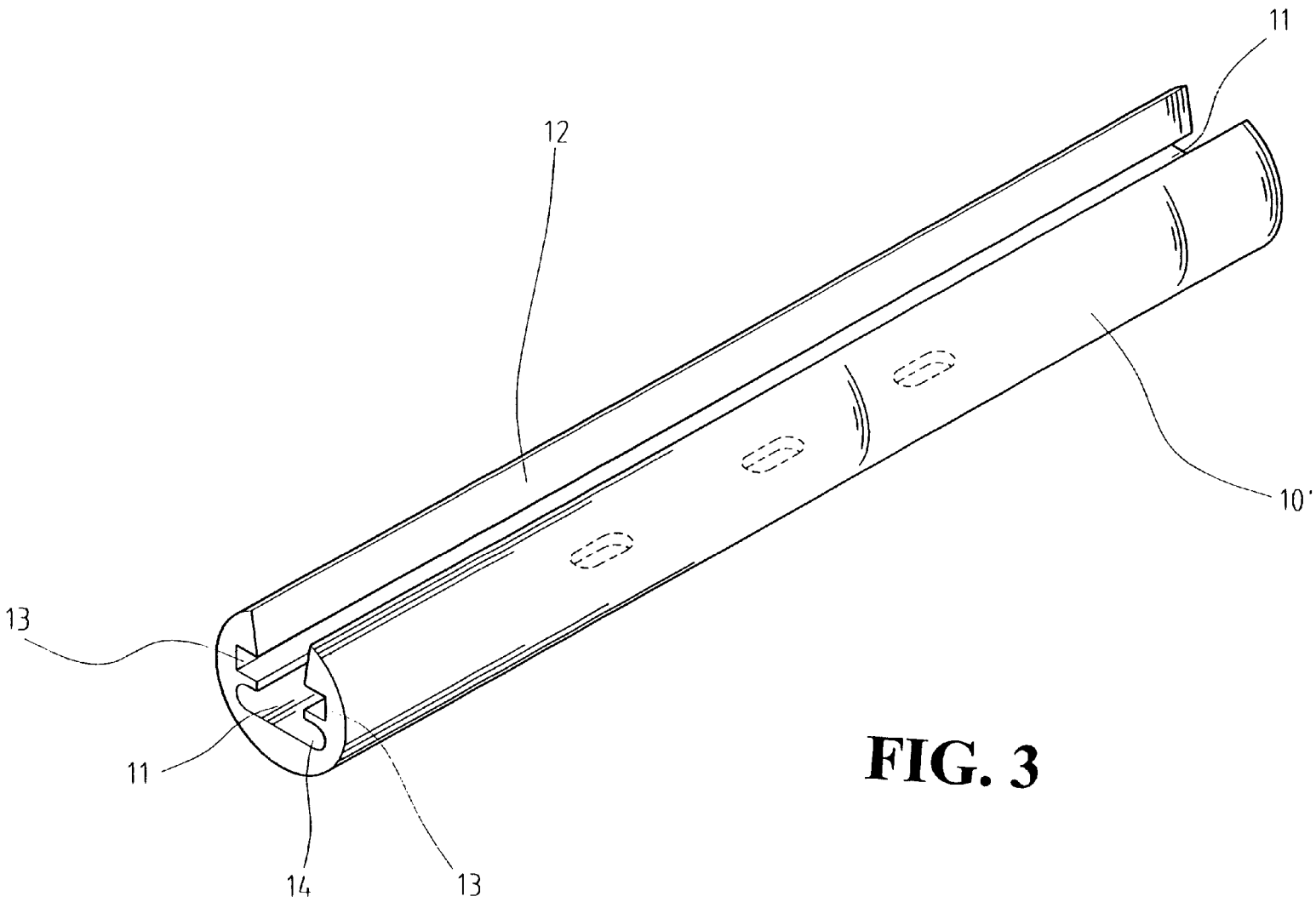
FIG. 3 is a three dimensional view of another embodiment of the lamp holder in accordance with the present invention.
Figure 7:
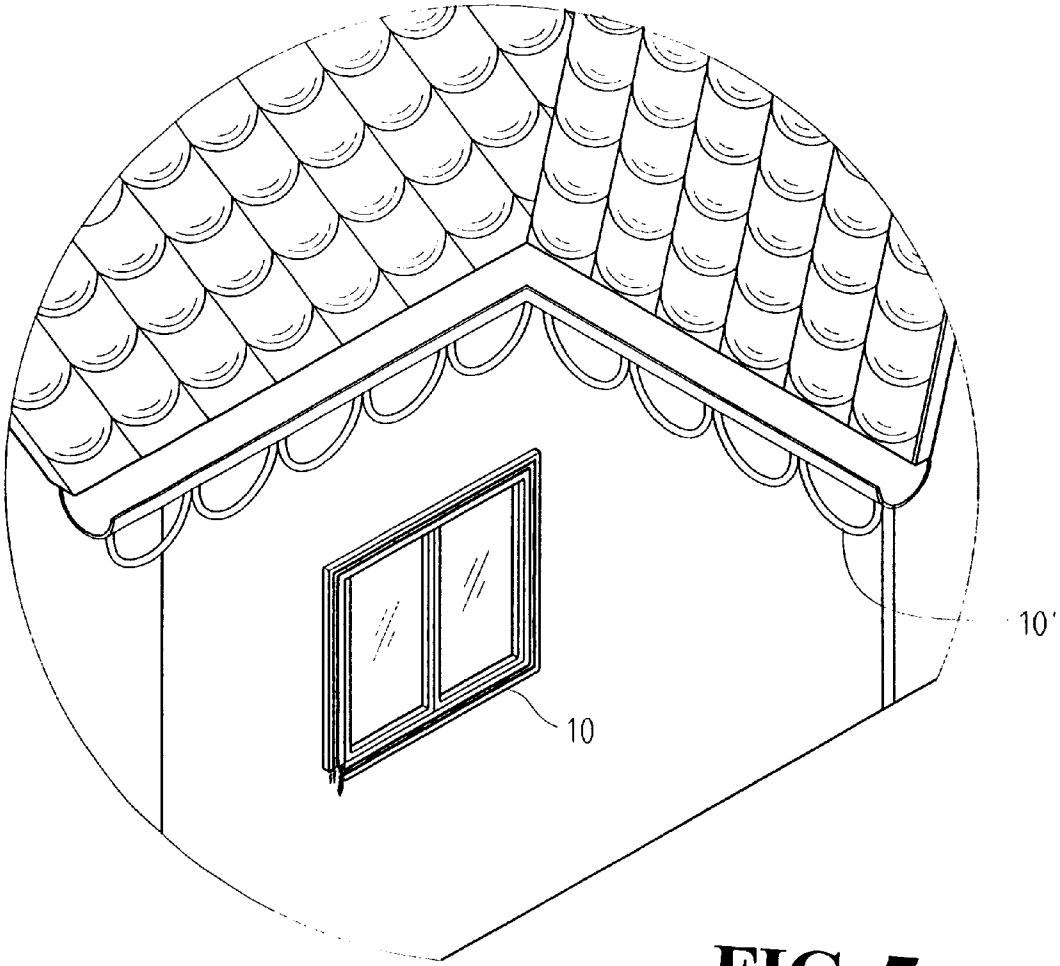
FIG. 7 is a schematic diagram illustrating the eaves and the window are respectively decorated by the curved and rectangular lamp holders in accordance with the present invention.

With reference to FIG. 3, another embodiment of the present invention shows the lamp holder 10' with another shape is similar to the above structure, such as the containing space 11, the side slot 13, and the containing slot 14 except the lamp holder 10' is a circular rod with an arc cross section. The lamp holder 10' is suitable for larger arc curve. As shown in FIG. 7, the lamp holder 10' is used to decorate the bottom of the eaves.

Figure 4:
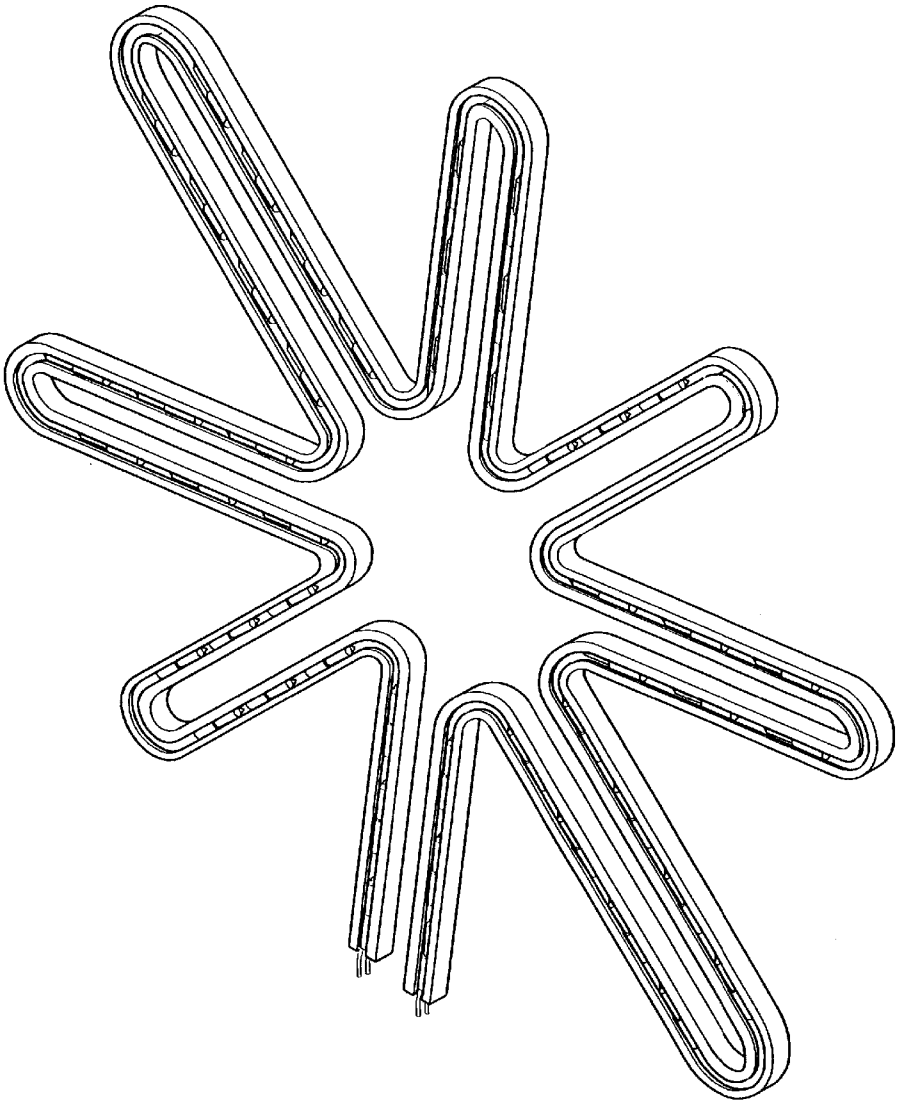
FIG. 4 is a three dimensional view showing the lamp holder of the present invention is bent to form a flake shape.
Figure 5:
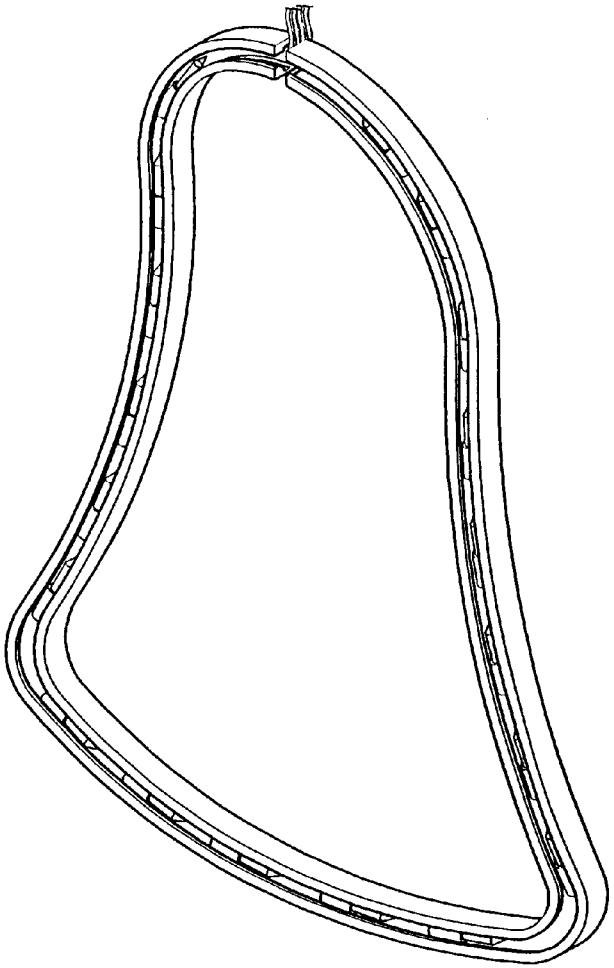
FIG. 5 is a three dimensional view showing the lamp holder of the present invention is bent to form a clock outline.
Figure 6:
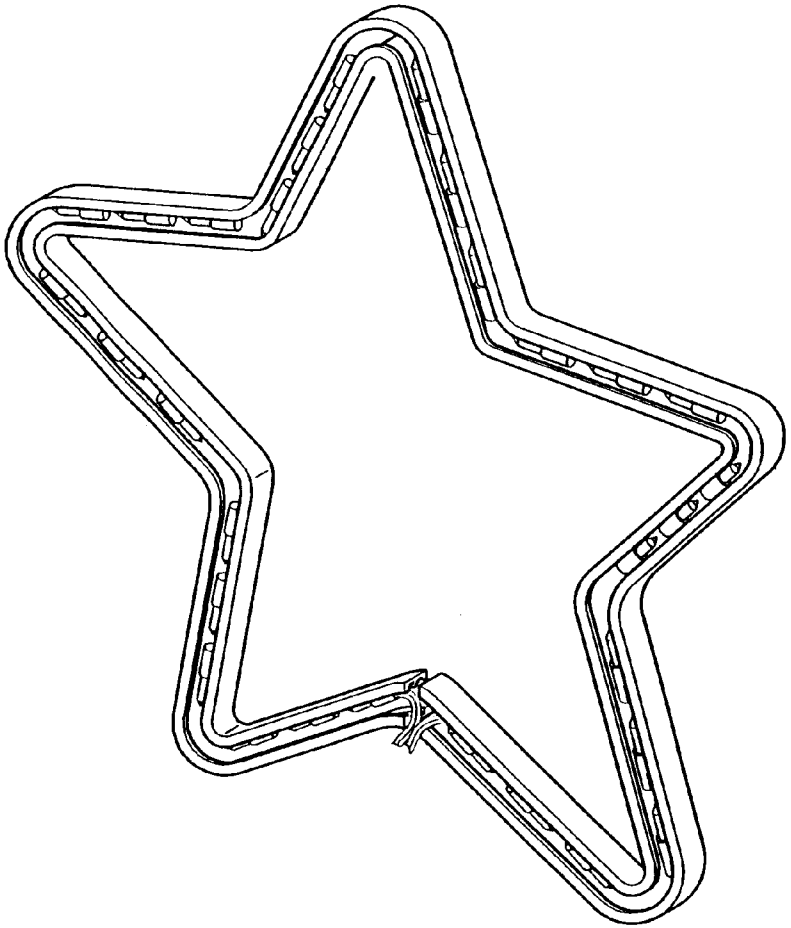
FIG. 6 is a three dimensional view showing the lamp holder of the present invention is bent to form a pentagram.

With reference to FIGS. 4, 5, and 6, the lamp string is contained in the lamp holder 10 with different shapes. The lamp holder 10 is made of flexible, highly transparent, and thermally endurable material such that the lamp holder 10 is easily bent to any shape with nearly complete transparency or partial transparency with color, and the safety is further enhanced during a long time of turn-on operation for the lamp string. FIG. 4 shows a flake shape, FIG. 5 a clock, and FIG. 6 a pentagram. In other words, the user may bend the lamp holder to any shape as desired. Furthermore, FIG. 7 illustrates two applications coordinated with the specific shapes of the target of the house, including the curved lamp holder 10' for the eaves and the rectangular lamp holder 10 for the window.

Figure 8:
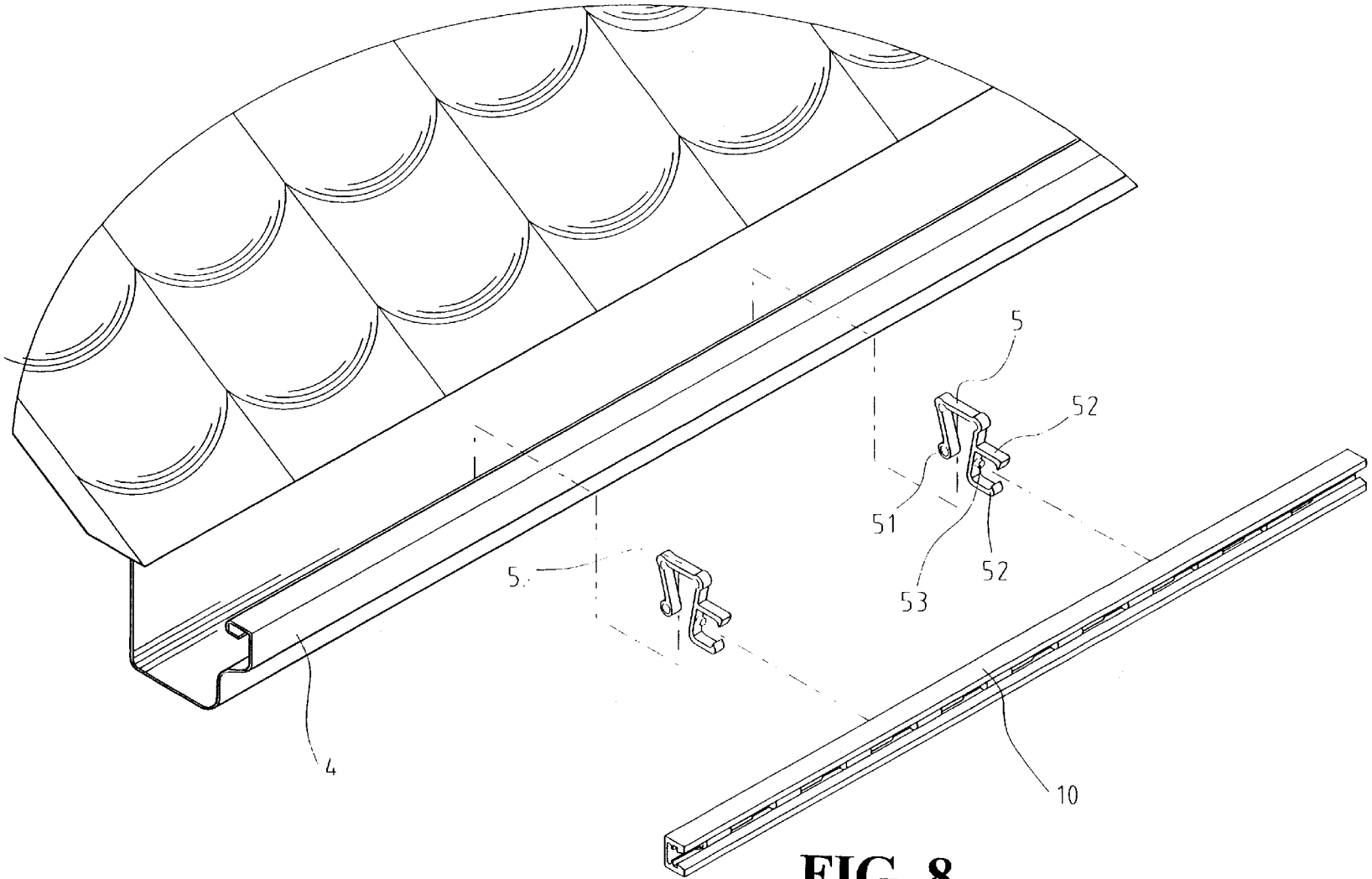
FIG. 8 is a schematic diagram illustrating the drainage pipe is decorated by the lamp holder in accordance with the present invention.

Additionally, FIG. 8 illustrates a schematic diagram where the drainage pipe 4 is decorated by the lamp holder 10 of the present invention. A fixing clamp 5 is needed as an auxiliary device, which is bent to an angle at one side and forms a ring 51 at one end and two clamp plates 52 at the other side. The clamp plates 52 form a hook as a C-shaped opening at the front end so as to clamp the lamp holder 10. The fixing clamp 5 is thus fixed to the drainage pipe 4 of the eaves. One side of the fixing clamp 5 includes a bump 53 located within the opening formed by the two clamp plates 52. The position of the bump 53 is aligned to the through hole at the bottom of the lamp holder 10 to prevent the lamp holder 10 from horizontally moving after being fixed to the through hole. The shape of the two clamp plates 52 is used to coordinate with the outlook of the lamp holder 10. Therefore, the lamp holder 10 can be easily fixed to the drainage pipe 4 of the eaves.

Although only the preferred embodiments of this invention were shown and described in the above description, it is requested that any modification or combination that comes within the spirit of this invention be protected.

What is claimed is:

1. A fixing clamp, comprising a main body, which bends to an angle at one side, and forms a ring at one end and two clamp plates at another side, wherein said two clamp plates form a hook at the front end as a C-shaped opening so as to fix a lamp string holder, which contains a lamp string comprising a plurality of decoration lamps.

2. The fixing clamp as claimed in claim 1, wherein said opening formed by two clamp plates is coordinated with a cross sectional shape of said lamp string holder.

3. The fixing clamp as claimed in claim 1, further comprising a bump at one side, located at a center of said opening, wherein said bump is aligned with a through hole at a bottom of said lamp string holder to prevent said lamp holder from horizontally moving after being fixed to said through hole.

4. A decoration lamp holder comprising a containing space for containing a lamp string, said containing space having a bottom and two inner side walls, each inner side wall having a first side slot for clamping and holding a plurality of lamps of said lamp string, and a second side slot for containing and hiding a wire of said lamp string; wherein said decoration lamp holder has a side opening for exposing said containing space and is made of a flexible rod comprising highly transparent and thermally endurable material.

5. The decoration lamp holder as claimed in claim 4, wherein said side opening has two tapered side walls connecting to said two inner side walls of said containing space.

6. The decoration lamp holder as claimed in claim 4, further having a two-sided tape adhered to an outer surface of said lamp holder for affixing said decoration lamp holder to a decorated target.

7. The decoration lamp holder as claimed in claim 4, further comprising a plurality of long holes formed through said bottom of said containing space.

8. The decoration lamp holder as claimed in claim 4, wherein said flexible rod is completely transparent.

9. The decoration lamp holder as claimed in claim 4, wherein said flexible rod is highly transparent with color.

10. The decoration lamp holder as claimed in claim 4, wherein each lamp of said lamp string has a lamp socket formed with two side blocks to be clamped in said first side slot.

11. The decoration lamp holder as claimed in claim 4, wherein said flexible rod has a substantially rectangular cross section.

12. The decoration lamp holder as claimed in claim 4, wherein said flexible rod has a substantially circular cross section.

* * * * *